United States Patent [19]

Foller

[11] Patent Number: 4,595,469

[45] Date of Patent: Jun. 17, 1986

[54] ELECTROLYTIC PROCESS FOR PRODUCTION OF GASEOUS HYDROGEN CHLORIDE AND AQUEOUS ALKALI METAL HYDROXIDE

[75] Inventor: Peter C. Foller, Berkeley, Calif.

[73] Assignee: Chevron Research Company, San Francisco, Calif.

[21] Appl. No.: 698,302

[22] Filed: Feb. 5, 1985

Related U.S. Application Data

[63] Continuation of Ser. No. 499,134, May 31, 1983, abandoned.

[51] Int. Cl.[4] ..... C25B 1/16; C25B 1/22

[52] U.S. Cl. ..... 204/98; 204/103

[58] Field of Search ..... 204/98, 103

[56] References Cited

U.S. PATENT DOCUMENTS

| | | | |
|---|---|---|---|
| 3,963,592 | 6/1976 | Lindström | 204/98 |
| 4,214,957 | 7/1980 | Ogawa et al. | 204/98 |
| 4,305,793 | 12/1981 | Broniewski | 204/98 |
| 4,312,720 | 1/1982 | Lefevre | 204/78 |

*Primary Examiner*—John F. Niebling
*Assistant Examiner*—Terryence Chapman
*Attorney, Agent, or Firm*—S. R. LaPaglia; R. C. Gaffney; J. J. DeYoung

[57] ABSTRACT

Disclosed is a process for the production of gaseous hydrogen chloride and aqueous alkali metal hydroxide from brine, utilizing an electrolytic cell containing a hydroxyl ion producing cathode and a gaseous hydrogen chloride producing hydrogen-consuming gas anode. Brine is fed to the anolyte compartment of the cell while alkali metal hydroxide is removed from the catholyte compartment of the cell, and gaseous hydrogen chloride is removed from the gaseous side of the hydrogen-consuming gas anode.

12 Claims, 3 Drawing Figures

ELECTROLYTIC PROCESS FOR PRODUCTION OF GASEOUS HYDROGEN CHLORIDE AND AQUEOUS ALKALI METAL HYDROXIDE

This is a continuation of application Ser. No. 499,134, filed May 31, 1983, now abandoned.

FIELD OF THE INVENTION

The present invention relates to electrochemical processes for the production of hydrogen chloride and aqueous alkali metal hydroxide from aqueous alkali metal chlorides.

BACKGROUND OF THE INVENTION

Electrolytic cell processes for the production of sodium hydroxide and chlorine from brine are well known in the art. In these processes, alkali is formed at the cathode while chlorine is formed at the anode. Additionally, hydrogen is formed at the cathode. Frequently, the commercial demand for chlorine has been less than the demand for sodium hydroxide which has lead producers to find other uses for the chlorine manufactured. Some have suggested reacting the chlorine gas with hydrogen to form hydrogen chloride gas which is then absorbed in water to form hydrochloric acid. Others have suggested avoiding the production of chlorine by reacting the chloride ions present in the electrolyte with hydrogen ions formed at a hydrogen gas anode forming hydrochloric acid in the liquid electrolyte.

One such patent is U.S. Pat. No. 3,963,592, which discloses a process in which the anodic reaction products can be varied to produce either chlorine or produce hydrogen chloride in the anolyte. The process utilizes an anode which is capable of operating both as a hydrogen anode or as a chlorine anode. When operated as a hydrogen anode, the hydrogen is passed through a first and then second layer of the anode into the anolyte where the hydrogen ions react with the chloride ions to produce hydrochloric acid in the anolyte.

Production of hydrogen chloride in the liquid anolyte may eliminate the step of chlorine production followed by reaction with hydrogen, however, separation of the hydrogen chloride from the brine of the anolyte poses difficult and expensive separation problems, as well as creating problems of low current efficiency.

SUMMARY OF THE INVENTION

A continuous process for the production of gaseous hydrogen chloride and aqueous alkali metal hydroxide in an electrolytic cell containing an anode, cathode, anolyte, catholyte, anolyte compartment, catholyte compartment and a diffusion barrier separating said anolyte and catholyte compartments, said barrier being selectively permeable to water and alkali metal ions which process comprises the steps of: (a) feeding an aqueous alkali metal chloride solution as anolyte into said anolyte compartment; (b) feeding a hydrogen-containing gas to the gaseous side of said gas diffusion anode; (c) maintaining an electrical potential between said cathode and anode whereby: (1) alkali metal ions and water pass from the anolyte through the diffusion barrier into the catholyte; (2) hydroxyl ions are formed at said cathode which react with said alkali metal ions forming alkali metal hydroxide in said catholyte; and (3) hydrogen is oxidized at said anode and the product hydrogen ions react with chloride ions producing hydrogen chloride; (d) withdrawing catholyte from said catholyte compartment, said catholyte comprising an aqueous solution of alkali metal hydroxide; and (e) withdrawing from the gaseous side of said anode gaseous hydrogen chloride, said gaseous hydrogen chloride comprising at least 50% by weight of the total quantity of hydrogen chloride produced at said anode.

DETAILED DESCRIPTION OF THE INVENTION

In the process of the present invention, conventional electrochemical apparatus which is well known in the industry can be utilized. This apparatus includes an electrolytic cell containing a cathode, liquid catholyte, a gas diffusion anode, anolyte and a diffusion barrier separating the anolyte and catholyte, said diffusion barrier being permeable in alkali metal ions and water.

The essential and most critical feature of the present invention resides in the operation of the electrolytic cell, particularly the anode, such that most of the hydrogen chloride formed at the anode escapes backside of the hydrogen gas anode as gaseous hydrogen chloride rather than forming and accumulating in the liquid anolyte posing difficult separation and current efficiency problems.

BRIEF DESCRIPTION OF THE DRAWINGS

In order to better understand the invention, reference is made to FIGS. 1 through 3.

The invention will be more particularly described with reference to the production of gaseous hydrogen chloride and aqueous sodium hydroxide from brine, although it is understood that other alkali metal chloride feeds can be used along with the corresponding alkali metal hydroxide being produced.

Figure 1:
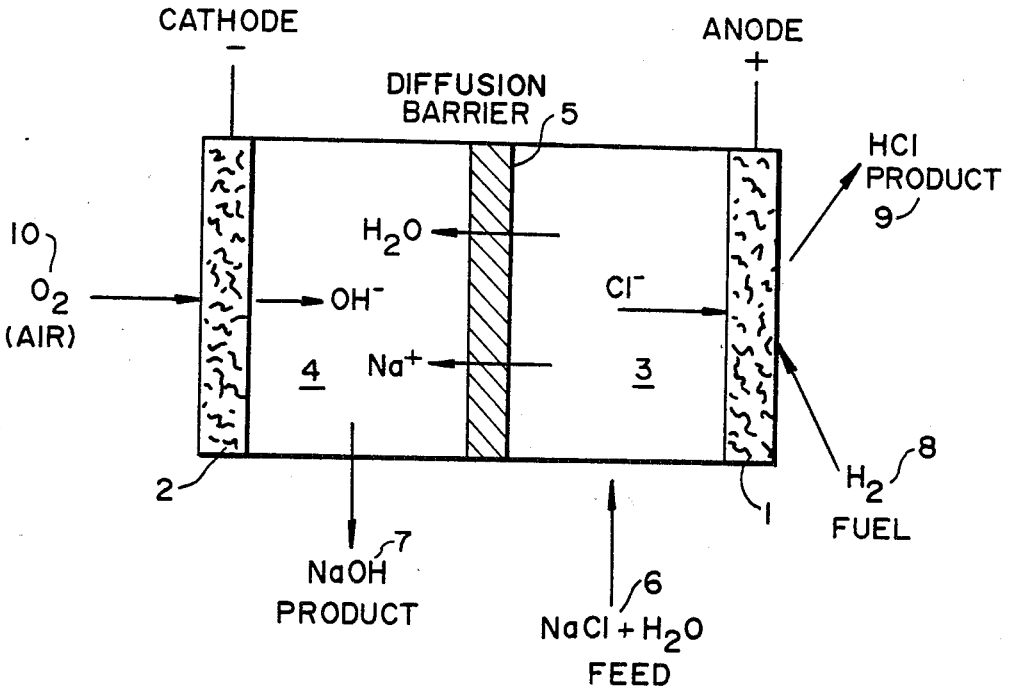
FIG. 1 is a flow diagram illustrating: (1) the flow of reactants into an electrolytic cell having a gas-consuming anode and cathode; (2) the movement of ions in the cell; (3) the chemical reactions taking place in the cell; and (4) the outflow of reaction products from the cell.

Referring now to FIG. 1, the electrolytic cell comprises an anode 1, a cathode 2, liquid anolyte 3, liquid catholyte 4, and a diffusion barrier 5 which separates the anolyte compartment from the catholyte compartment. The diffusion barrier is selectively permeable to the movement of sodium ions and water, and maintains the pH differential between the anolyte and catholyte. The pH of the anolyte will be in the range 8 to 0, preferably 7 to 1. The pH of the catholyte will be in the range 10 to 15, preferably 13 to 15. Such diffusion barriers are well known in the art with the perfluorinated cation exchange membranes representing one preferred type (e.g.: DuPont's Nafion). Brine is fed to the cell via inlet means 6 and product aqueous sodium hydroxide is withdrawn via outlet means 7 and passed, if desired, to a sodium hydroxide concentrator not shown. Anode 1 comprises a gas diffusion-type fuel cell anode where a hydrogen-containing gas 8 is oxidized. Product gaseous hydrogen chloride 9 is withdrawn from the gaseous side of the anode along with unreacted hydrogen. The unreacted hydrogen and product hydrogen chloride can be separated by a variety of known methods, including pressure swing absorption, solvent absorption/desorption and membrane diffusion.

In the most preferred embodiment of the invention, the cathode is an air cathode and an oxygen-containing gas 10 is reduced. When an electrical potential is maintained between the anode and cathode, the following electrode reactions take place:

$$\text{Anode} \quad H_2 \longrightarrow 2H^+ + 2e^-$$

$$\text{Cathode} \quad 2e^- + \tfrac{1}{2} O_2 + H_2O \longrightarrow 2OH^-$$

$$H_2O + H_2 + \tfrac{1}{2} O_2 + 2NaCl \longrightarrow NaOH + 2HCl$$

Hydroxyl ions are formed at the cathode and sodium hydroxide is formed in the catholyte. The sodium ions and water pass from the anolyte through the diffusion barrier. Hydrogen is oxidized at (and within) the anode forming hydrogen ions which react with chloride ions migrating through the anolyte and into the anode forming hydrogen chloride.

Alternatively, but less preferably, hydroxyl ions can be formed at the cathode through the reduction of water in the catholyte which also produces hydrogen at the cathode as follows:

$$H_2O + e^- \rightarrow OH^- + \tfrac{1}{2}H_2$$

Figure 2:
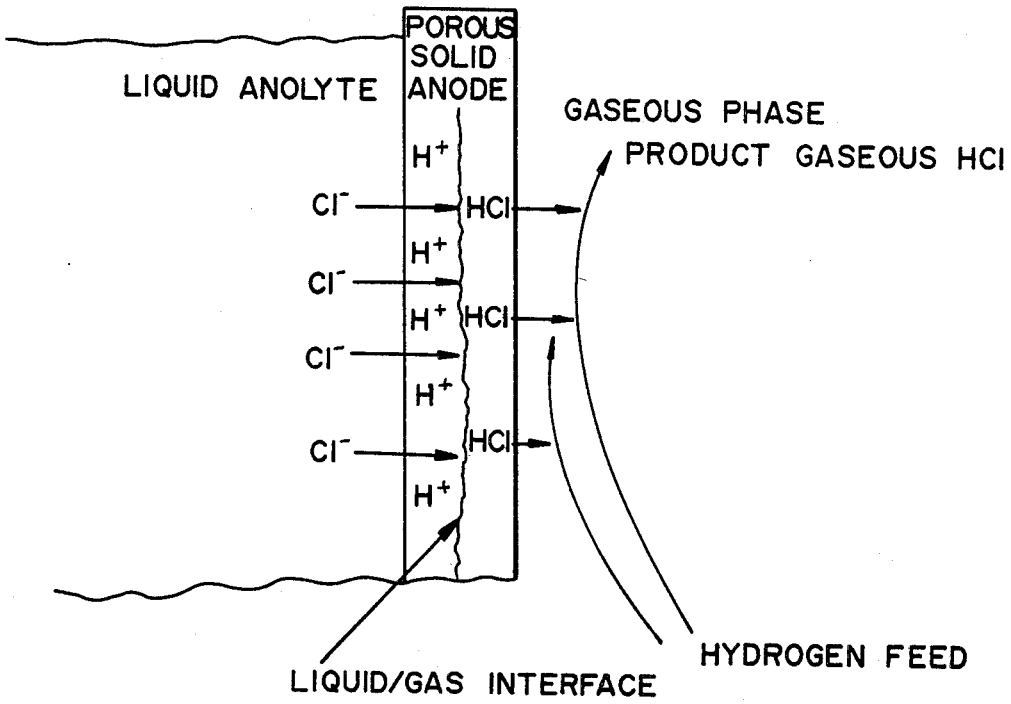
FIG. 2 illustrates in more detail the production and removal of gaseous hydrogen chloride at the anode of the cell shown in FIG. 1.

Referring now to FIG. 2 which is an amplified illustration of what occurs at (or inside of) the anode of the present invention. As previously mentioned the most critical feature of the present invention resides in operating the electrolytic cell, particularly the anode, such that most of the hydrogen chloride formed at the anode escapes "backside" into the gaseous side of the anode rather than passing through the anode into the liquid anolyte. This is accomplished by using a gas diffusion anode which is porous to chloride ions, hydrogen ions, gaseous hydrogen and gaseous hydrogen chloride, and substantially impermeable to the movement of liquid anolyte completely through the anode. A portion of the hydrogen-containing gas passes into the anode forming hydrogen ions which then reacts with the chloride ions to produce hydrogen chloride. By maintaining the gaseous pressure low enough, most of the gaseous hydrogen chloride formed is able to escape the anode via the gaseous side of the anode and is swept away from the anode along with unreacted hydrogen. Normally, the process will be operated with the hydrogen-containing gas being fed to the gaseous side of the anode at a pressure in the range 0.5 to 20 atmospheres, preferably at atmospheric pressure.

The anode is constructed to allow a three-phase interface for oxidation of hydrogen and with anion exchange properties to enhance generation of gaseous hydrogen chloride. The anode is constructed to allow chloride ions to enter the anode from the anolyte while also allowing hydrogen to enter the anode where it is oxidized to hydrogen ions. The reaction of the chloride ions and hydrogen ions is believed to occur at the gas-liquid interface and gaseous hydrogen chloride escapes the electrode via the gaseous side of the anode.

At least 50% by weight and preferably 90% by weight and more preferably 95% by weight of all of the hydrogen chloride formed in the process is removed from the cell as gaseous hydrogen chloride via the gaseous side of the anode. If most of the hydrogen chloride were to enter the anolyte without continuous replacement by fresh anolyte, as is practiced in the prior art, eventually hydrogen chloride would accumulate in the anolyte to a point where the solubility of sodium chloride would be severely suppressed. Also, hydrogen ion would be transported across the membrane in competition with sodium ions, thus reducing the current efficiency of the process.

One example of an anode structure which allows the desired ion transfer and reactions to take place is formed from high-surface-area carbon catalyzed with a highly dispersed noble metal which is bonded into a porous semihydrophobic structure using a polymer such as polytetrafluoroethylene (Teflon®). This active material can be placed onto or within a Teflon-impregnated carbon paper or carbon cloth support. Alternatively, it may be rolled into a fine-metallic mesh to improve current collection and distribution. Generally, it is preferred that the anode has a high internal surface area to increase the rate of transfer of hydrogen chloride from the gas/liquid interface into the gaseous phase. The high surface area of the anode allows a high concentration of hydrogen chloride within the anode, thereby increasing the vapor pressure of hydrogen chloride in the anode relative to the vapor pressure of water. Preferably, the anode is made from carbon having a surface area in the range 25 to 300 meters$^2$/gram, and preferably 50 to 250 meters$^2$/gram.

The anode can also be functionalized to inhibit hydrogen chloride from entering the electrolyte by positively charged groups affixed to the electrode which inhibit the diffusion of hydrogen chloride (formed in the electrode) to the bulk of the anolyte. This feature is more particularly described in my copending application Ser. No. 499,135, now U.S. Pat. No. 4,977,322 entitled "Gas Diffusion Anode and Process For Producing Hydrogen Chloride", filed on the same date as the present invention, the entire disclosure of which is incorporated herein by reference.

Figure 3:
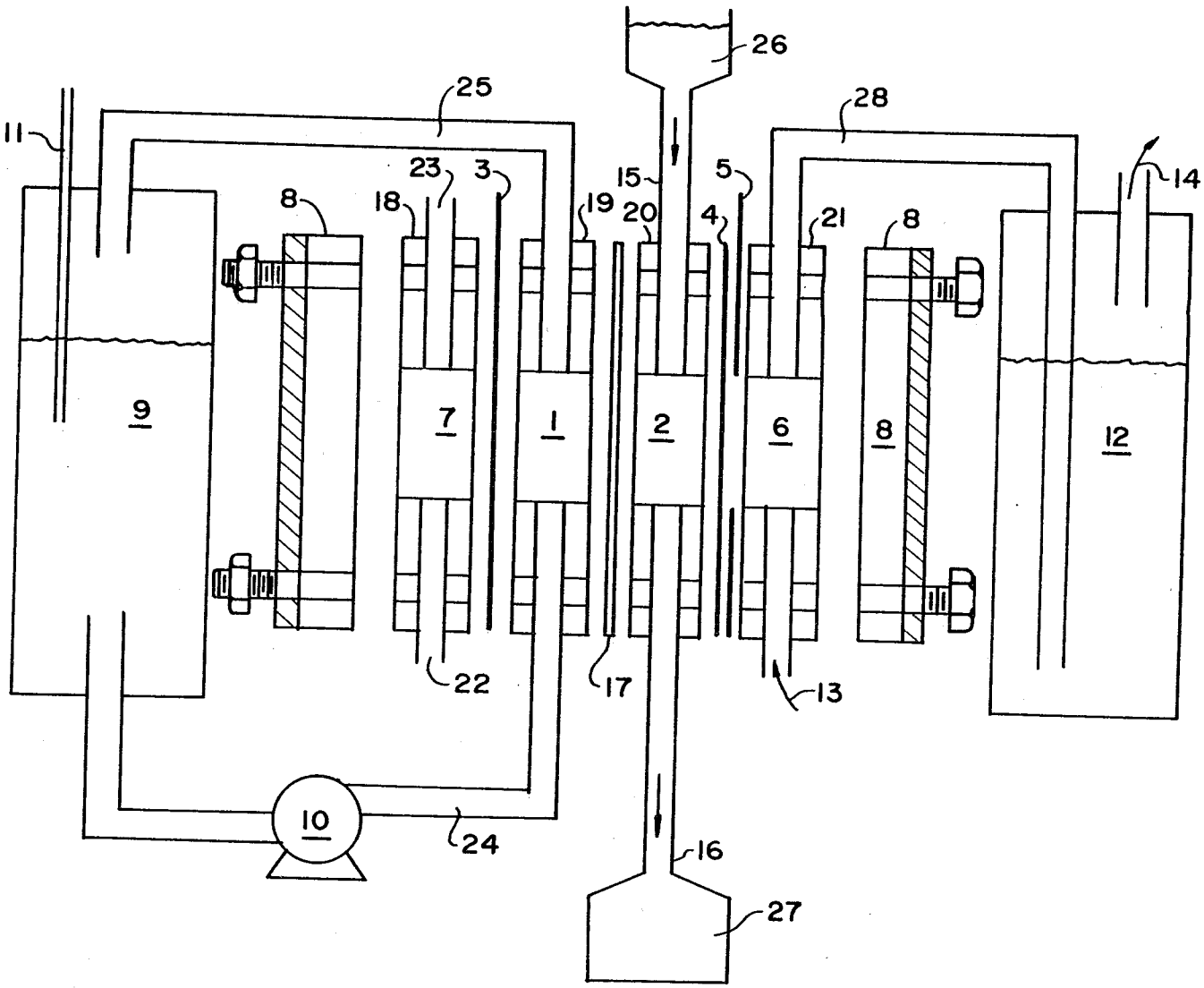
FIG. 3 illustrates one embodiment of the invention utilized in reference to the examples.

One embodiment of the invention is further illustrated by the following example and FIG. 3.

EXAMPLE

The apparatus used in these experiments is shown in FIG. 3. A hydrogen-evolving cathode was used in preference to an air cathode to simplify the initial experiments reported. This apparatus is an electolysis cell composed of several 3"×4"×¾" slabs of polypropylene (8, 18, 19, 20, and 21) bolted together in a filter press configuration. The two end slabs (8) have heating elements attached to the outer surfaces. Slab (18) contains a chamber (7) connected to the atmosphere through tubes (22) and (23). Slab (19) contains the catholyte compartment (1) connected to a catholyte reservoir (9) through tube (24) and pump (10). Concentrated catholyte returns to the reservoir through line (25). Hydrogen formed at the cathode is exhausted through line (25). Catholyte sampling is done through (11). A 20 cm$^2$ nickel cathode (3) is inserted between slabs (18) and (19).

Slab (20) contains the anolyte compartment (2), connected to a brine reservoir (26) through tube (15). Spent anolyte passes to container (27) through tube (16). A standard Nafion 415 membrane (17) is clamped between slabs (19) and (20).

Slab (21) contains a hydrogen flow-by chamber (6). Hydrogen gas is supplied through line (13) and vented out line (28). The hydrogen off-gas passes through water scrubber (12) thereby removing HCl from the hydrogen, which is then vented to the atmosphere through line (14). An anode (4) comprising a 20 $cm^2$ standard platinum-catalyzed high-surface-area carbon composite sintered with 50% by weight Teflon, and a graphite current distribution plate (5) are positioned between slabs (20) and (21).

Using this apparatus, several runs were carried out at a temperature of 50° C. at a current density of 50 mA/cm. Brine solutions of the indicated concentrations were passed through the 37 ml anolyte compartment at 1 ml/min. The catholyte solution, 146 ml, was charged to the reservoir and circulated through the catholyte compartment at 180 ml/min. Hydrogen gas was passed through the anode blow-by chamber at 80 ml/min. (STP). The results are summarized in Table 1.

TABLE 1

Brine Electrolysis with Gaseous HCl Recovery

| Run No. | Electricity (Coulombs) | Brine (M) | Catholyte Conc. (M) Start | Catholyte Conc. (M) Finish | Scrubber HCl (1)% Theory | Current (2)Eff., % |
|---|---|---|---|---|---|---|
| 1 | 21800 | 4 | 4.34 | 5.23 | — | 92.4 |
| 2 | 5944 | 4 | 3.50 | 3.78 | — | 92.7 |
| 3 | 7631 | 2 | 0.84 | 1.29 | 69 | 92.4 |
| 4 | 7113 | 4 | 1.45 | 1.80 | 49 | 82.4 |

(1)Calculated from quantity of HCl present in water trap.
(2)Calculated from quantity of NaOH formed during run.

The process of the present invention can be operated over a wide range of process variables. Generally, the concentration of sodium chloride in the anolyte will be 1 to 5.5 molar, preferably 3 to 5 molar and the concentration of the aqueous sodium hydroxide withdrawn from the catholyte will be 5 to 40, preferably 30 to 35 weight percent. Generally, it is also preferred that the anolyte and catholyte be maintained at a temperature of 25° to 90° C., preferably 50° to 80° C. while the electrical potential between the anode and air cathode is 0.2 to 1.5 volts, preferably 0.4 to 0.8 volts.

Other embodiments of the invention will be readily apparent to those skilled in the art. For example, the hydrogen-containing gas can be supplied from a conventional reforming unit using natural gas or other hydrocarbon fuels as a feed with excess heat from the reformer being utilized in further concentration of the aqueous sodium hydroxide or driving the separation of the hydrogen chloride from the unreacted hydrogen. The separation can be performed, for example, by solvent absorption/desorption using dimethylformamide. Similarly, if one desires chlorine as a product, the gaseous and substantially anhydrous hydrogen chloride can be converted to chlorine using the well known Kel-Chlor process.

What is claimed is:

1. A continuous process for the production of gaseous hydrogen chloride and aqueous alkali metal hydroxide in an electrolytic cell containing an anode, cathode, anolyte, catholyte, anolyte compartment, catholyte compartment and a diffusion barrier separating said anolyte and catholyte compartments, said barrier being selectively permeable to water and alkali metal ions and said anode being a gas diffusion anode having a liquid side in contact with said anolyte and a gaseous side opposite said liquid side, which process comprises the steps of:

(a) feeding an aqueous alkali metal chloride solution as anolyte into said anolyte compartment;

(b) feeding a hydrogen-containing gas to the gaseous side of said gas diffusion anode;

(c) maintaining an electrical potential between said cathode and anode whereby;

(1) alkali metal ions and water pass from the anolyte through the diffusion barrier into the catholyte;

(2) hydroxy ions are formed at said cathode which react with said alkali metal ions forming alkali metal hydroxide in said catholyte; and (3) hydrogen is oxidized at said anode and reacts with chloride ions producing hydrogen chloride;

(d) withdrawing catholyte from said catholyte compartment, said catholyte comprising an aqueous solution of alkali metal hydroxide;

(e) maintaining the pressure on the gaseous side of said anode such that at least 50% by weight of said hydrogen chloride produced at said anode escapes said anode via the gaseous side of said anode as gaseous hydrogen chloride; and (f) withdrawing from the gaseous side of said anode gaseous hydrogen chloride, said gaseous hydrogen chloride comprising at least 50% by weight of the total quantity of hydrogen chloride produced at said anode.

2. The process of claim 1 wherein said cathode is a gas diffusion cathode and an oxygen-containing gas is fed to the gaseous side of said gas diffusion cathode.

3. The process of claim 2 wherein said alkali metal chloride is sodium chloride and said alkali metal hydroxide is sodium hydroxide.

4. The process of claim 3 wherein the electrical potential between said anode and cathode is maintained in the range of 0.2 to 1.5 volts.

5. The process of claim 4 wherein (a) the concentration of sodium chloride in said anolyte is 1 to 5.5 molar;

(b) the concentration of sodium hydroxide in said catholyte is 5 to 40 weight percent; and (c) the electrical potential between said cathode and anode is maintained at 0.4 to 0.8 volts.

6. The process of claim 5 wherein at least 90% by weight of the total quantity of hydrogen chloride produced at said anode is withdrawn from the gaseous side of said anode.

7. The process of claim 5 wherein at least 95% by weight of the total quantity of hydrogen chloride produced at said anode is withdrawn from the gaseous side of said anode.

8. A continuous process for the production of gaseous hydrogen chloride and aqueous alkali metal hydroxide in an electrolytic cell containing an anode, cathode, anolyte, catholyte, anolyte compartment, catholyte compartment and a diffusion barrier separating said anolyte and catholyte compartments, said barrier being selectively permeable to water and alkali metal ions and said anode being a gas diffusion anode having a liquid side in contact with said anolyte and a gaseous side opposite said liquid side, which process comprises the steps of:

(a) feeding an aqueous alkali metal chloride solution as anolyte into said anolyte compartment;

(b) feeding a hydrogen-containing gas to the gaseous side of said gas diffusion anode;

(c) maintaining an electrical potential between said cathode and anode whereby:

(1) alkali metal ions and water pass from the anolyte through the diffusion barrier into the catholyte;

(2) hydroxy ions are formed at said cathode which react with said alkali metal ions forming alkali metal hydroxide in said catholyte; and (3) hydrogen is oxidized at said anode and reacts with chloride ions producing hydrogen chloride;

(d) withdrawing catholyte from said catholyte compartment, said catholyte comprising an aqueous solution of alkali metal hydroxide;

(e) maintaining the pressure on the gaseous side of said anode such that at least 90% by weight of said hydrogen chloride produced at said anode escapes escapes said anode via the gaseous side of said anode as gaseous hydrogen chloride; and (f) withdrawing from the gaseous side of said anode gaseous hydrogen chloride, said gaseous hydrogen chloride comprising at least 90% by weight of the total quantity of hydrogen chloride produced at said anode.

9. The process of claim 8 wherein said cathode is a gas diffusion cathode and an oxygen-containing gas is fed to the gaseous side of said gas diffusion cathode.

10. The process of claim 9 wherein said alkali metal chloride is sodium chloride and said alkali metal hydroxide is sodium hydroxide.

11. The process of claim 10 wherein the electrical potential between said anode and cathode is maintained in the range of 0.2 to 1.5 volts.

12. The process of claim 11 wherein (a) the concentration of sodium chloride in said anolyte is 1 to 5.5 molar;

(b) the concentration of sodium hydroxide in said catholyte is 5 to 40 weight percent; and (c) the electrical potential between said cathode and anode is maintained at 0.4 to 0.8 volts.

* * * * *